US011939721B2

(12) United States Patent
Kolhe

(10) Patent No.: US 11,939,721 B2
(45) Date of Patent: Mar. 26, 2024

(54) METHOD FOR NON-CATALYTIC DELIGNIFICATION OF BIOMASS INSIDE AN APPARATUS

(71) Applicant: LIGNOPURA AGROTECH PVT LTD., Maharashtra (IN)

(72) Inventor: Nitin Kolhe, Nasak (IN)

(73) Assignee: LIGNOPURA AGROTECH PVT LTD. (IN)

( * ) Notice: Subject to any disclaimer, the term of this patent is extended or adjusted under 35 U.S.C. 154(b) by 331 days.

(21) Appl. No.: 17/423,106

(22) PCT Filed: Jan. 13, 2020

(86) PCT No.: PCT/IB2020/050220
§ 371 (c)(1),
(2) Date: Jul. 14, 2021

(87) PCT Pub. No.: WO2020/148623
PCT Pub. Date: Jul. 23, 2020

(65) Prior Publication Data

US 2022/0136171 A1 May 5, 2022

(30) Foreign Application Priority Data

Jan. 18, 2019 (IN) ..... 201921002226

(51) Int. Cl.

| | |
|---|---|
| ***D21C 3/20*** | (2006.01) |
| ***D21C 1/02*** | (2006.01) |
| ***D21C 3/26*** | (2006.01) |
| ***D21H 11/02*** | (2006.01) |
| ***D21H 11/12*** | (2006.01) |

(52) U.S. Cl.
CPC ..... *D21C 3/20* (2013.01); *D21C 1/02* (2013.01); *D21C 3/263* (2013.01); *D21H 11/02* (2013.01); *D21H 11/12* (2013.01)

(58) Field of Classification Search
CPC . D21C 3/20; D21C 1/02; D21C 3/263; D21C 9/147; D21H 11/02; D21H 11/12
See application file for complete search history.

(56) References Cited

U.S. PATENT DOCUMENTS

2016/0031921 A1* 2/2016 Manesh ..... D21C 1/00 524/72

FOREIGN PATENT DOCUMENTS

| | | | | |
|---|---|---|---|---|
| DE | 3807272 A | * | 9/1989 | ..... A62D 3/37 |
| DE | 3807272 A1 | | 9/1989 | |
| WO | WO2012093982 A1 | | 7/2012 | |
| WO | WO2014163652 A1 | | 10/2014 | |

* cited by examiner

*Primary Examiner* — Eric Hug
*Assistant Examiner* — Matthew M Eslami
(74) *Attorney, Agent, or Firm* — Vani Moodley, Esq.

(57) ABSTRACT

The present invention provides a method for non-catalytic delignification of biomass, without externally added catalyst, with a mixed solvent of oxygenated organic solvent and water in the presence of an oxidant, at moderate temperature and pressure. Further, the separation of delignified cellulose from liquid mixture is carried out at around equivalent process conditions. Low modified kappa number delignified cellulose is obtained after separation of a liquid mixture containing a mixed solvent, hemicelluloses, lignin and traces of miscellaneous compounds. Furthermore, the method has lower chemical consumption in the downstream process, ease of operation and robustness.

9 Claims, 2 Drawing Sheets

METHOD FOR NON-CATALYTIC DELIGNIFICATION OF BIOMASS INSIDE AN APPARATUS

FIELD OF THE INVENTION

The present invention relates to an improved method for the delignification of biomass. More particularly, the present invention relates to an improved method for the delignification of biomass without using externally added catalyst.

BACKGROUND OF THE INVENTION

Generally, the demand for the production of fuel and energy is increasing day by day. The first generation biofuels are generated from starch, sugar, animal fats and vegetable oil, require a huge amount of energy, time, and cost for pre-treatment processes. The biomass is mainly composed of cellulose, lignin, and hemicelluloses. Therefore, it needs to be treated for removal and extraction of hemicelluloses and lignin from the lingo-cellulosic biomass. Different biomasses include wheat straw, barley straw, sugarcane bagasse, rapeseed residues, switch grass, and cellulosic waste products. Earlier, the removal and extraction of lignin and hemicelluloses from the biomass done using an aqueous organic solvent in the presence of a catalyst (sulphuric acid) to produce the delignified cellulose, which leads to the formation of a side product, such as furfural and the like and increased downstream processing complexities with reduced yield.

Till date, there is no such process which can cut down complexities produced in the existing process of extracting and removing lignin and hemicelluloses from lingo-cellulosic biomass.

Therefore, there is a need to provide a process which can overcome the limitation and drawbacks of existing processes.

OBJECTS OF THE INVENTION

Object of the present invention is to provide an improved method for the delignification of biomass.

Another object of the present invention is to provide an improved method for the delignification of biomass having lower chemical consumption in the downstream process.

Yet another object of the present invention is to provide an improved method for the delignification of biomass having reduced wastewater load.

Further object of the present invention is to provide an improved method for the delignification of biomass to produce a final product with lower modified kappa number. Modified kappa number measured in the present invention has been estimated as per the method specified by Li and Gellerstedt (Nordic Pulp Paper Res. J. 2002, 17, 410-414).

Further one object of the present invention is to provide an improved method for the delignification of biomass, which increases the overall yield of delignified cellulose.

Another object of the present invention is to provide an improved method for the delignification of biomass, which is economical with ease of operation.

Yet another object of the present invention is to provide an improved method for the delignification of biomass, which is robust in operation.

SUMMARY OF THE INVENTION

According to the present invention, a method for non-catalytic delignification of biomass inside an apparatus is provided. At first, a stream is added inside an apparatus. The stream is a water-washed cellulose-rich lignocellulosic biomass. Further, the stream is treated with a treatment liquid in the presence of oxygen-containing gas in the apparatus at a temperature of 120-170° C. and initial pressure of 3 to 100 bar, wherein the treatment liquid is a mixture of water and oxygenated solvent. The treatment liquid is having 30-70% w/w of an oxygenated solvent comprising an ether, ketone and/or an ester group and 30-70% w/w of water. The oxygen-containing gas is having 2 to 100% volume of oxygen. The oxygenated solvent includes one or more ketones, or the oxygenated solvent may be an acetone Further, the apparatus is operated either in batch or semi-batch or continuous mode. The apparatus is arranged in a single or multistage manner with a combination of series and parallel in co-current or counter-current or cross flow arrangement.

Further, in this method, the separation of delignified cellulose at the end of delignification is carried out at ±50% of equivalent process conditions. In the present embodiment, the lignocellulosic biomass is a softwood, a hardwood, agricultural wastes (such as sugarcane bagasse, wheat straw, and corn stover), herbaceous crops, forestry wastes and other lignocellulosic wastes, preferably wherein agricultural wastes.

The delignification of biomass is performed using a mass ratio of a liquid to solid in the range of 5 to 20. Further, the method ensures pulp quality of modified kappa number less than 15.

DETAILED DESCRIPTION OF THE INVENTION

An embodiment of this invention, illustrating its features, will now be described in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides an improved method for non-catalytic delignification of biomass. The method has lower chemical consumption in the downstream process. Also, the process has reduced wastewater load. The process produces the final product with lower modified kappa number. Further, the process increases the overall yield of delignified cellulose. Furthermore, the process is economical with ease of operation. Moreover, the process is robust in operation.

Figure 1:
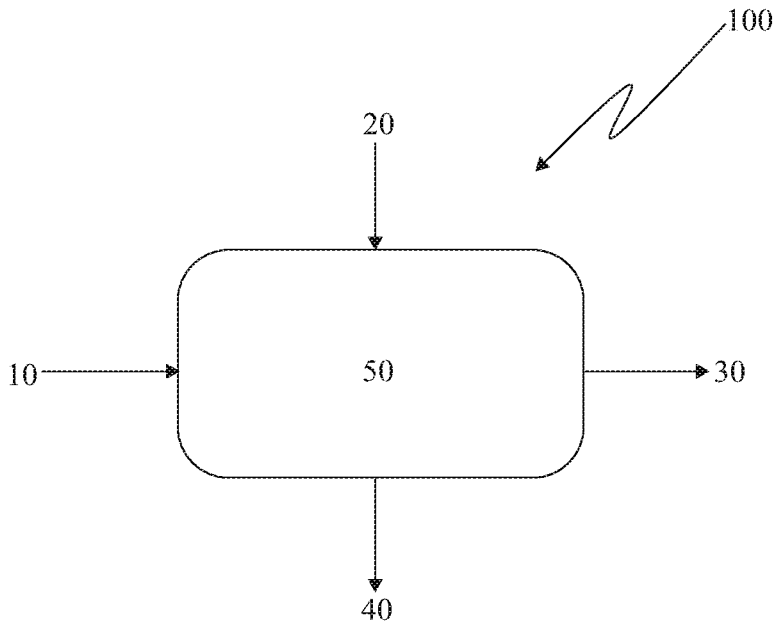
FIG. 1 shows a schematic of an improved method for non-catalytic delignification of biomass in accordance with the present invention.

Referring to FIG. 1, schematic of an improved method for non-catalytic delignification of biomass in accordance with the present invention is illustrated. The method 100 is used for removing the maximum amount of lignin and hemicelluloses from lignocellulosic biomass. The method 100 uses an apparatus 50 for the delignification process. The apparatus 50 can be a closed chamber or a container for adding the mixtures used for the method 100. The mixtures may include a stream 10 and a treatment liquid 20. The stream 10 is a water-washed cellulose-rich lignocellulosic biomass. The treatment liquid 20 is a mixture of water and oxygenated solvent. After the addition of the stream 10 and the treatment liquid 20, the delignification process starts, and the apparatus 50 delivers the delignified cellulose in the form of a stream 30. Along with the stream 30, a stream 40 containing a liquid mixture of mixed solvent, hemicelluloses, lignin and traces of miscellaneous compounds, is delivered after separation of the delignified cellulose. The method 100 operates in batch mode. Also, the method 100 may be operated in semi-batch or continuous mode.

Figure 2:
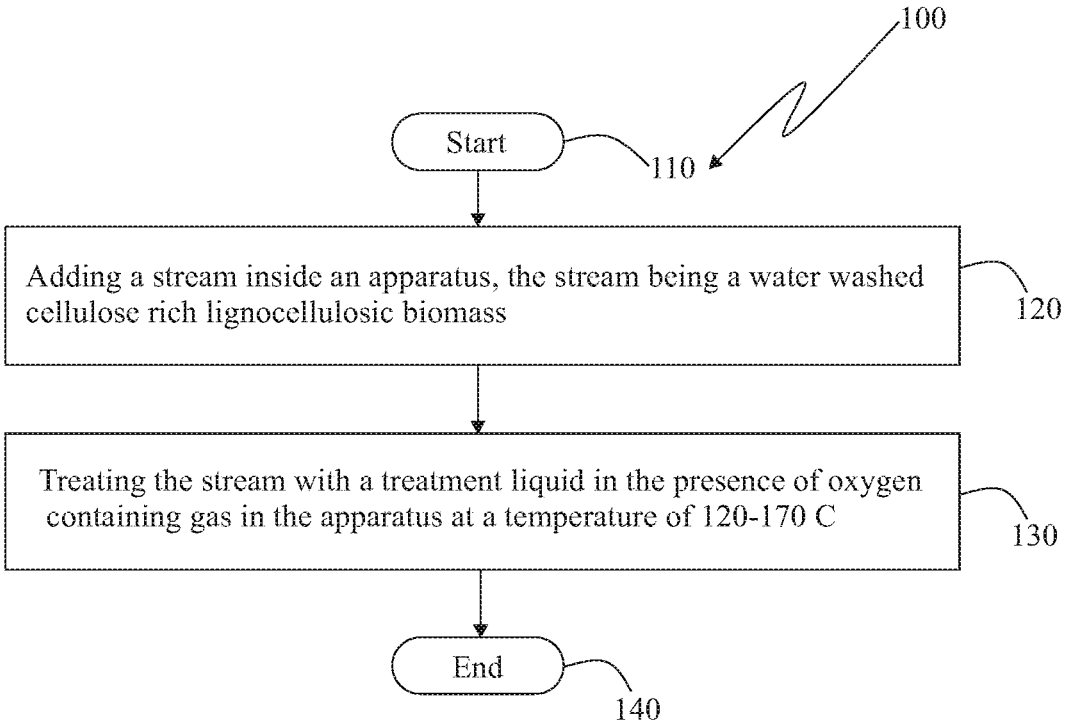
FIG. 2 illustrates a method for non-catalytic delignification of biomass in accordance with the present invention

Referring now to FIG. 2, a flowchart portraying the method 100 is illustrated.

The method 100 starts at step 110.

At step 120, a stream is added inside the apparatus. The stream 10 is the water washed cellulose-rich lignocellulosic biomass. In the present method, the biomass may be a fresh or dried biomass. In the present invention, the cellulose-rich lignocellulosic biomass is a softwood, a hardwood, agricultural wastes (such as sugarcane bagasse, wheat straw, and corn stover), herbaceous crops, forestry wastes and other lignocellulosic wastes. The lignocellulosic biomass contains 20% to 80% of carbohydrates and 5% to 35% of lignin. The lignocellulosic biomass is washed to remove the impurities like pith, metal and stones, etc. Prior to water washing, the lignocellulosic biomass is milled, ground or chopped to small pieces. The size of the ground or chopped lignocellulosic biomass depends on the type of biomass used in grinding or chopping.

At step 130, the stream is treated with the treatment liquid in the presence of oxygen-containing gas in the apparatus at a temperature of 120-170° C. and initial pressure of 3 to 100 bar. The treatment liquid is a mixture of water and oxygenated solvent. Specifically, the treatment liquid is a mixture of 30-70% w/w of an oxygenated solvent comprising an ether, ketone and/or an ester group and 30-70% w/w of water.

The oxygenated solvent should have at least one oxygen function (ether, ketone, ester). If the oxygen function is ether, then the oxygenated organic solvent is dioxane, tetrahydrofurane (THF), dimethoxymethane and the like. If the oxygen function is a ketone, then the oxygenated solvent is acetone, butanone, methyl isobutyl ketone, cyclohexanone, ethyllevuinic, methyl levulinic and the like. If the oxygen function is an ester, then the oxygenated organic solvent is lactone (most preferably γ-valerolactone), ethyl acetate, propyl acetate, butyl acetate and the like. The composition of the oxygenated organic solvent in the treatment liquid can vary from 20% to 90% w/w, preferably 30% to 70% w/w.

In the present invention, the oxygen-containing gas is used as an oxidant in the treatment liquid. The oxygen-containing gas is either in the form of oxygen or air or a mixture of oxygen with any of the inert gases like nitrogen, argon, helium and krypton. In the present embodiment, the oxygen-containing gas is having 2 to 100% volume of oxygen. The initial pressure of the oxidant is kept higher than atmospheric pressure to start the delignification process. The volume percent of oxygen in the treatment liquid ranges between lean concentration (i.e. as low as 2 vol. % of oxygen) to rich concentration (i.e. as high as 100 vol. % of oxygen).

Further, the washed lignocellulosic biomass of the stream 10 is mixed in the apparatus 50 (referred as a block in FIG. 1) with an oxygenated organic solvent-water mixture of the treatment liquid in the presence of oxidant of the treatment liquid. The apparatus 50 can be operated either in batch or semi-batch or continuous mode, preferably batch. The apparatus 50 can be arranged in a single or multistage manner with a combination of series and parallel in co-current or counter-current or cross flow arrangement. The mass ratio of the oxygenated solvent of the treatment liquid is in the range of 3 to 50, preferably 5 to 20. The biomass fractionation in the apparatus 50 is performed at a moderate temperature, typically in the range of 100-180° C., preferably 120-170° C. and initial pressure at room temperature, typically in the range of 1 to 150 bar, preferably 3 to 100 bar, ensures effective delignification of cellulose-rich lignocellulosic biomass into cellulose, hemicellulose, lignin and traces of miscellaneous components. Specifically, the delignification of biomass is performed using a mass ratio of a liquid to solid in the range of 5 to 20.

At the end of the delignification process, the separation of delignified cellulose from a liquid mixture in the apparatus 50 is carried out at equivalent or lower or higher process conditions, preferably at ±50% of equivalent process conditions. As the apparatus 50 can also be arranged in a multistage manner with a combination of series and parallel in co-current or counter-current or cross flow arrangement, the streams will move accordingly prior to coming out of the multistage arrangement of apparatus 50.

The separated delignified cellulose in the form of the stream 30 has lower modified kappa number. The modified kappa number measured in the present invention has been estimated as per the method specified by Li and Gellerstedt (Nordic Pulp Paper Res. J. 2002, 17, 410-414). In the present invention, the modified kappa number ranges from 10 to 15. Specifically, the method 100 ensures pulp quality of modified kappa number less than 15.

The stream 40 contains a liquid mixture of mixed solvent, hemicelluloses, lignin and traces of miscellaneous compounds, after separation of delignified cellulose. Further, stream 40 is processed for recycling purpose.

The method 100 ends at step 140.

Example-1

Water-washed depithed bagasse (stream 10: typical weight composition of bagasse—46-48% cellulose, 26-28% hemicellulose, 21-23% lignin and balance is extractable impurities) was subjected to an improved delignification process in a multistage manner through the apparatus 50 in batch mode. Multi-stages, preferably two stages, were operated in a cross-flow recycle combination manner. Acetone used as an oxygenated solvent along with water (acetone: water=55:45 wt. %) of the treatment liquid is mixed in the apparatus 50 in the presence of oxygen-rich air (>90 vol. %) of treatment liquid. The ratio of oxygenated solvent (Acetone+water) of treatment liquid to stream 10 was maintained around 10 (dry basis of solid) initially. The same ratio of oxygenated solvent (Acetone+water) to dry depithed bagasse was maintained in multistage operation. All batch operations were performed at an initial pressure of 8 bar (at room temperature) and temperature around 150° C.+/−2° C.

Inter-stage cum final separation of solids, after the delignification reaction, from a liquid stream rich in the mixed solvent, lignin and hemicellulose provide distinct streams for its further use in the subsequent stages and downstream. Delignification reaction happens in each stage at specified process conditions as stated above. Inter-stage cum final separation of a solid-liquid mixture is being carried out at around equivalent process conditions of delignification reaction as stated above. The inter-stage delignification is achieved in the range of 50±5%.

At the end of the process, the liquid stream (stream 40) separated from solid pulp contains a mixed solvent, lignin, hemicellulose and other miscellaneous compounds. Whereas, the solid stream (stream 30) provides cellulose pulp with a yield of ~53±3% and modified kappa number of 13.0±0.5 due to higher delignification of depithed bagasse, greater than 90%.

Example-2

As like example-1, delignification was performed in the presence of oxygen-rich air (around 50 vol. %) of treatment liquid. All other operations and conditions were kept the same except an initial pressure of around 15 bar (at room temperature).

Cellulose pulp obtained with a yield of ~53±3% and modified kappa number of 14.0±0.5 due to higher delignification of depithed bagasse, greater than 90%.

Example-3

As like example-1, delignification was performed in the presence of air of treatment liquid. All other operations and conditions were kept the same except an initial pressure of around 37 bar (at room temperature).

Cellulose pulp obtained with a yield of around ~53±3% and modified kappa number of 14.0±0.5 due to higher delignification of depithed bagasse, greater than 90%.

Therefore, the present invention provides an improved method 100 for the delignification of biomass. The method 100 has lower chemical consumption in the downstream process. Also, the method 100 has reduced wastewater load. The method 100 produces the final product with lower modified kappa number. Further, the method 100 increases the overall yield of delignified cellulose. Furthermore, the method 100 is economical with ease of operation. Moreover, the method 100 is robust in operation.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the scope of the claims of the present invention.

I claim:

1. A method for non-catalytic delignification of biomass, the method comprising the steps of:

adding a stream of water-washed cellulose-rich lignocellulosic biomass inside an apparatus; and treating the stream with a treatment liquid in presence of an oxygen-containing gas in the apparatus at a temperature of 120-170° C. and at an initial pressure of 3 to 100 bar, wherein the treatment liquid is a mixture of water and an oxygenated solvent, wherein the treatment liquid comprises:

30-70% w/w of the oxygenated solvent comprising at least one of an ether, a ketone, and an ester group; and 30-70% w/w of water;

the oxygen-containing gas comprises 2 to 100% volume of oxygen, the oxygen-containing gas is either in the form of oxygen or air or a mixture of oxygen with an inert gas;

wherein the method produces pulp with a pulp quality of modified kappa number less than 15.

2. The method as claimed in claim 1, wherein the apparatus is operated in a mode selected from the group consisting of a batch mode, a semi-batch mode, and a continuous mode.

3. The method as claimed in claim 1, wherein the apparatus is arranged in at least one of a single stage and a multistage manner, wherein for the multistage case, the stages are arranged as a combination of series and parallel stages, and wherein the arrangement of the apparatus is selected from the group consisting of a co-current arrangement, a counter-current arrangement, and a cross flow arrangement.

4. The method as claimed in claim 1, wherein the oxygenated solvent comprises at least one ketone.

5. The method as claimed in claim 1, wherein the oxygenated solvent is an acetone.

6. The method as claimed in claim 1, further comprising separating a delignified cellulose at an end of the delignification at ±50% of equivalent process conditions.

7. The method as claimed in claim 1, wherein the lignocellulosic biomass is selected from the group consisting of a softwood, a hardwood, agricultural wastes, herbaceous crops, forestry wastes, and lignocellulosic wastes.

8. The method as claimed in claim 7, wherein the agricultural wastes are selected from the group consisting of sugarcane bagasse, wheat straw, and corn stover.

9. The method as claimed in claim 1, wherein the delignification of biomass is performed using a mass ratio of a liquid to solid in the range of 5 to 20.

* * * * *